US005228387A

United States Patent [19]

Siculan

[11] Patent Number: 5,228,387

[45] Date of Patent: Jul. 20, 1993

[54] MULTICOLOR BLOCK PRINTING PROCESS

[76] Inventor: Daniel Siculan, 2523 Allison Ct., Glenview, Ill. 60025

[21] Appl. No.: 951,182

[22] Filed: Sep. 24, 1992

[51] Int. Cl.[5] ..... B41F 5/00; B41K 1/56

[52] U.S. Cl. ..... 101/211; 101/333; 101/405

[58] Field of Search ..... 101/211, 405, 406, 327, 101/333, 382.1, 171, 481, 485, 486, 490, 492, 493

[56] References Cited

U.S. PATENT DOCUMENTS

| | | | |
|---|---|---|---|
| 804,326 | 11/1905 | Keeler | 101/333 |
| 2,214,687 | 9/1940 | Weiss | 101/211 |
| 2,242,295 | 5/1941 | Foard | 101/211 |
| 2,645,049 | 7/1953 | Brown | 101/211 |
| 2,767,481 | 10/1956 | Christen | 101/211 |
| 2,819,668 | 1/1958 | McAneny | 101/405 |
| 2,835,196 | 5/1958 | Herbert et al. | 101/333 |
| 3,020,838 | 2/1962 | Prost | 101/333 |
| 3,843,133 | 10/1974 | Brown | 101/333 |
| 4,998,473 | 3/1991 | Laureyns | 101/333 |
| 5,115,729 | 5/1992 | Beckman | 101/405 |

FOREIGN PATENT DOCUMENTS

| | | | |
|---|---|---|---|
| 563741 | 11/1932 | Fed. Rep. of Germany | 101/211 |
| 3210634 | 12/1982 | Fed. Rep. of Germany | 101/405 |
| 2307659 | 12/1976 | France | 101/405 |
| 727981 | 4/1955 | United Kingdom | 101/333 |

OTHER PUBLICATIONS

Clearsnap Catalog 1990-1991, Clearsnap, Inc., Anacortes, WA 98221, pp. 1-4, 7, 23 & 24.

Inkadinkado Catalog, Inkadinkado, Inc., 105 South Street, Boston, Mass. 02111, pp. 2-4, 33, 37 & Cover, 1990 copyright.

Clearsnap Circulars (two sheets), Clearsnap, Inc., Anacortes, Wash. 98221—Copyright 1991.

*Primary Examiner*—Eugene H. Eickholt

*Attorney, Agent, or Firm*—James A. Geppert

[57] ABSTRACT

An improved method and apparatus for the manual block printing of multicolor images upon an article to be printed, wherein the article is inserted between a printer base and a generally rectangular housing having means to yieldably urge said housing onto the base, a pair of guide members adjustably secured onto the printer base for registration and alignment of a corner of the article receiving the image, and a printer having a tray holder, a printing tray received on said tray holder and having a recess on its underside to receive a rubber cushion with the image thereon, and a handle projecting upward to allow the operator to manually insert and remove the printer from the housing to transfer ink from an ink source to the article to be printed. A number of images are provided, each image used for a single color of ink, and the articles are repeatably aligned for transfer of each image and color of ink in turn to form the final multicolor image.

20 Claims, 2 Drawing Sheets

MULTICOLOR BLOCK PRINTING PROCESS

TECHNICAL FIELD

The invention disclosed herein relates to improvements in a multicolor block printing process and apparatus for printing multicolor copies of a picture, figure or other drawing with complete registration of the articles receiving the several colors upon which the printing is applied.

BACKGROUND

Block printing and/or ink stamp pads have been in existence for many years going back to linoleum block printing of drawings or figures for illustrations in books, etc. However, block printing of more than a single color has always been a complicated and tedious process. The design is formed on the block by cutting away or otherwise removing portions of the block surface where ink is not desired and the remaining raised portions will receive ink from a roller or ink pad applied to the block. The block with the ink thereon is pressed down onto the paper or like material to receive the image and the ink is transferred thereto. Depending on the skill of the printer in forming the design, images formed on the block and/or rubber stamps have become more intricate and can be more easily worked with respect to the final image, and have thus improved the process.

More recently, rubber surfaced rollers with multiple repeating images have come into use where a string or line of images are to be transferred onto an article, such as footprints, musical notes or other repeatable figures. However, these figures are still used with only one color of ink to be transferred from the ink pad onto the article receiving the image. With colored pencils or, more recently, felt tip marking pens, cutouts or blank spaces in a design can be colored in after the image outline is transferred to the article and the ink has dried.

A problem arises where multiple colors are desired for the final image. The use of colored pencils or felt tipped markers is one solution to the problem, however, this again is a slow and tedious process. It may be desirable to utilize various colors of ink to provide a multicolored image from a series of blocks or stamps. Where such an image is desired, a major problem is the registration of the multiple images so that the colors do not overlap but present a completely defined image of the final design. One way to do this is to provide a multiple colored ink pad so that various portions of the image will be in the different colors of the color portions of the ink pad. Another method of providing the multiple colors is by hand positioning of the blocks or stamps with the different colors of the image, however, where a substantial number of articles are to be printed with the same image, the skill of the operator to reproduce the same image with the proper colors on each article becomes critical. It would be highly desirable not to have to rely on the skill of the operator for the proper registration of the various colors of the images if a large number of the multicolor images are desired. A further method of producing the multicolored image would be to use a rubber stamp and markers of the various colors to ink the various portions of the stamp surface with the colors, and then press the stamp on the article receiving the image. Again, for a large number of articles, this method would very slow and laborious. The present invention provides a method and apparatus for the accurate reproduction of multicolored images with complete registration of each color of the image which is transferred onto the article receiving the final image.

DISCLOSURE OF THE INVENTION

The present invention relates to the method and apparatus for multicolored block printing of an intricate image onto an article, such as a greeting card, where the apparatus provides complete and accurate registration of the various colored images in a sequence of steps for each color of the image. The apparatus consists of a printer and a guide and holder which provides for the repeated registration of the articles upon which the printing or stamping is accomplished; the holder having a pair of adjustable guides to accurately position one corner of the article and a central housing which receives the block printer or stamp to transfer the ink to the article from the block or printing plate. The guide and holder is provided with a base plate to provide a flat bed-type printing method which is capable of multicolor printing, and the base plate is provided with pairs of parallel slots for independent movement of the guide members resulting in accurate repeated registration of the article to have multicolor printing; the movable registration guide members having bolts received in and extending through the slots. The printer includes a handle to be manually grasped by the operator and a tray holder carrying a printing tray with the image thereon. The image is inked by printing ink on a roller or stamp pad ink in a particular color, and the tray holder and printing tray are inserted within the generally rectangular box or housing on the base to receive and accurately position the tray and image for vertical movement therein to register with the article receiving the image.

The present invention also relates to a novel method of multicolor printing onto an article where a series of articles are successively mounted and positioned on the tray holder of the printer and the printer is manually pressed onto each article with an image of a certain color forming a portion of the final image. Once all of the articles have been imprinted with one color, the articles are again positioned on the base beneath the housing and a second printing tray having an image for a second color is applied to the article. This process is repeated for each successive color until the final image is complete. Due to the nature of the apparatus, each article is repeatably accurately positioned beneath the housing so that there is complete registration of the various images in the different colors to form the final multicolor figure desired on the article.

MODES FOR CARRYING OUT THE INVENTION

Figure 1:
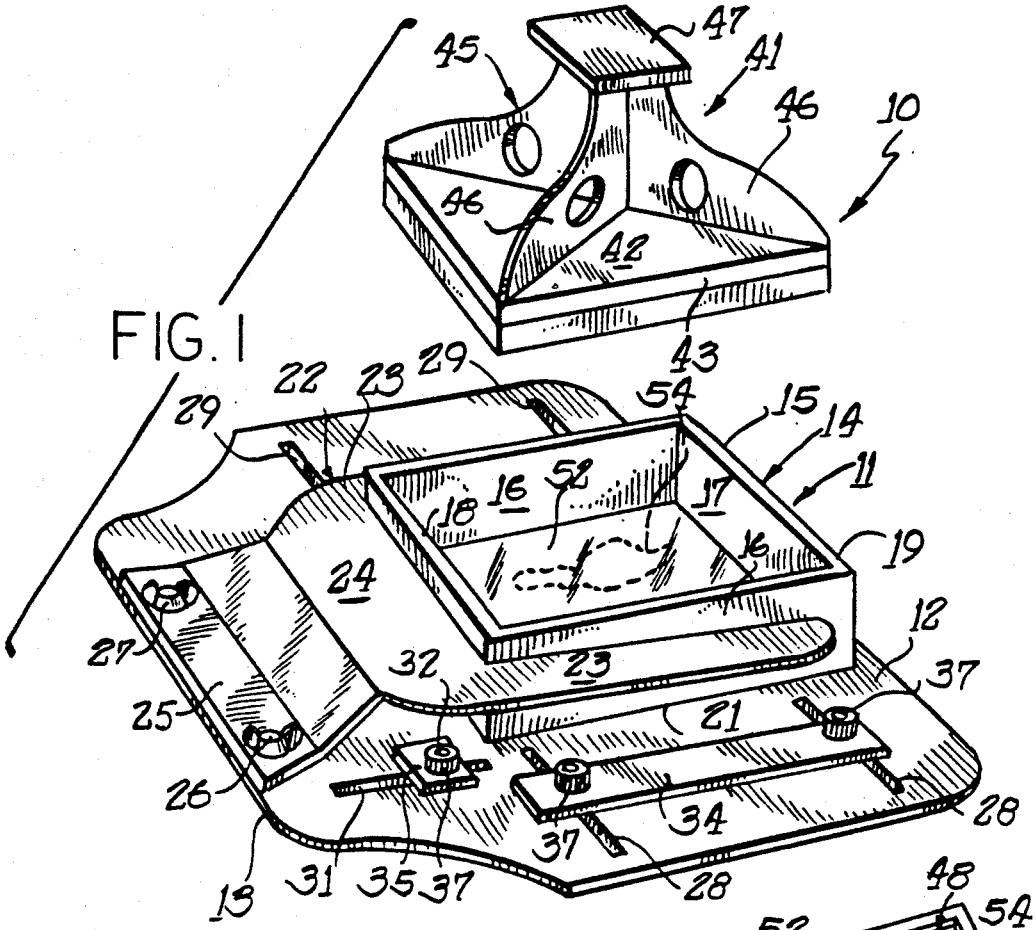
FIG. 1 is an exploded perspective view of the block printing apparatus of the present invention with a printing plate positioned within the guide housing.
Figure 3:
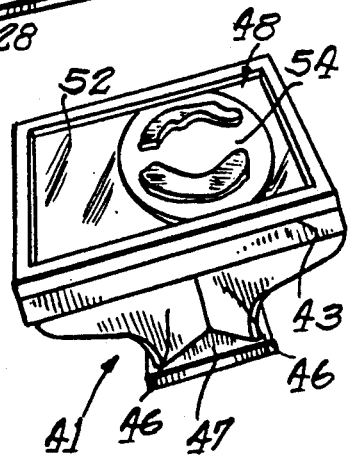
FIG. 3 is a perspective view of the underside of the printer showing the printing plate having an image thereon.
Figure 2:
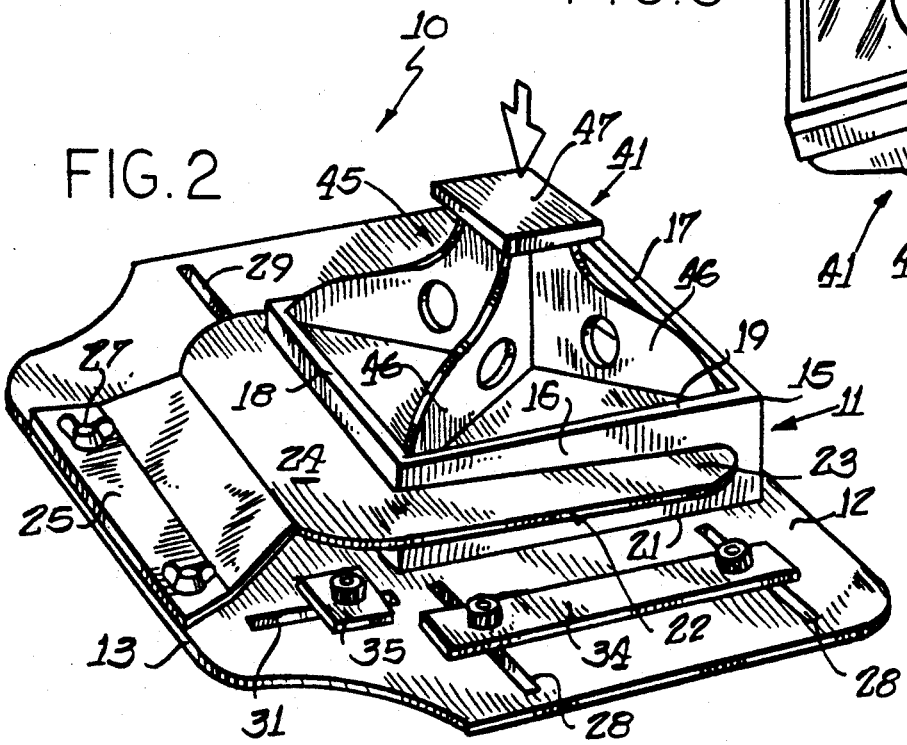
FIG. 2 is a perspective view of the printing apparatus of FIG. 1, but showing the printer inserted in the housing to print an image on an article positioned on the base plate.
Figure 4:
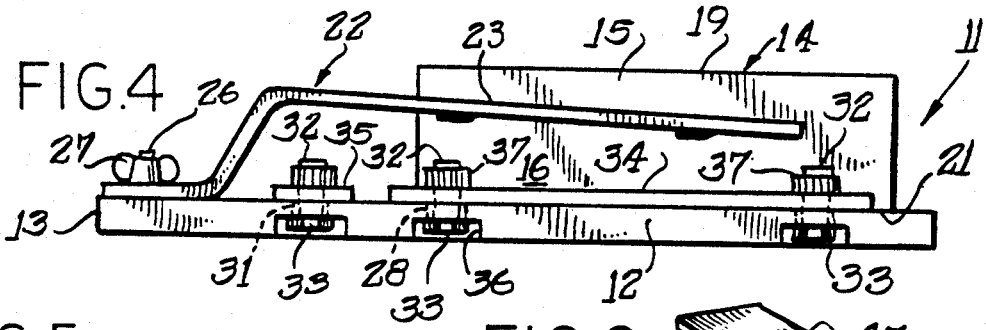
FIG. 4 is a side elevational view of the guide holder and base plate of the apparatus.
Figure 5:
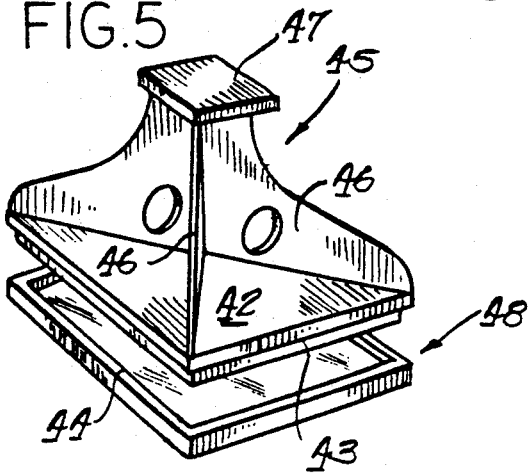
FIG. 5 is an exploded perspective view of the printer and printing plate.
Figure 6:
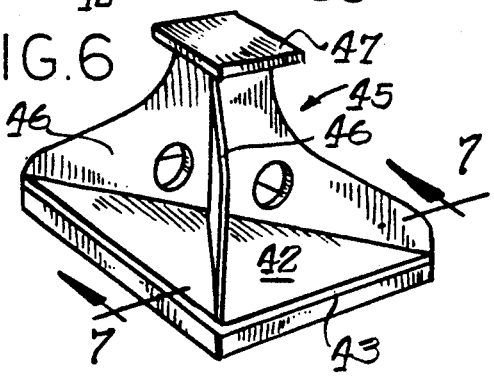
FIG. 6 is a perspective view of the assembled printer.
Figure 7:
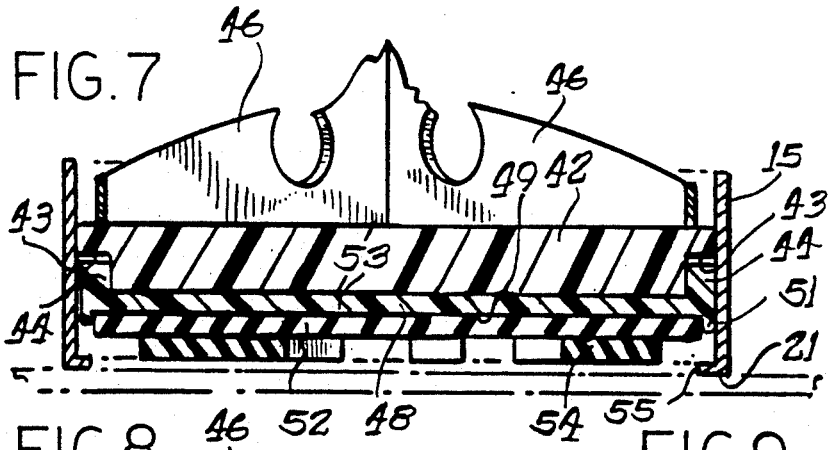
FIG. 7 is a vertical cross sectional view of the printer taken on the line 7—7 of FIG. 6 and positioned in the guide housing.

Referring more particularly to the disclosure in the drawings wherein are shown illustrative embodiments of the present invention, FIGS. 1 and 2 disclose an improved multicolor block printing apparatus 10 which includes an article receiving base member 11 and a printer 41. The base member is of generally rectangular configuration with a base plate 12 and a holder and guide 14 in the form of a rectangular box or housing 15 having parallel sides 16,16, a front 17 and a back 18; with the front, back, and sides provided with upper edges 19 and lower edges 21. The lower edges 21 are adapted to rest on and hold down the article being printed (not shown).

A generally U-shaped support 22 for the guide box 15 has parallel arms 23, 23 suitably secured to parallel sides 16 of the box and joined by a central portion 24 having a downwardly offset flange 25 with openings to receive bolts 26 extending upward through the base plate 12 adjacent the rear edge 13. Wing nuts 27 or other suitable securing means are provided to secure and retain the holder and guide onto the base plate, and the light tension provided b the angle of the flange 25 for the support 22 aids in the function of yieldably holding down the article to be printed. Pairs of parallel slots 28,28, 29,29 and 31,31 are formed within the base plate on three sides of the holder to receive adjustment bolts 32 extending through a pair of registration guide members 34 and 35 on the base plate. The underside of each slot is enlarged at 36 to receive an enlarged bolt head 33 conformably fitting therein to prevent rotation thereof. Each bolt is slidable along its respective slot and has a knurled or wing nut 37 for manual tightening of the bolt and thus securement of each guide member on the base plate in adjusted position. The side guide member 34 may be positioned at either set of slots 28 or 29 and the short top guide member 35 may be positioned at either of the slots 31, depending on which pair of side slots is utilized.

Figure 9:
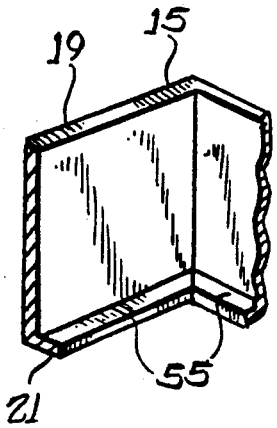
FIG. 9 is a partial perspective view of an interior corner of the guide housing.

The printer 41 includes a generally rectangular tray holder or printer base 42 suitably conforming to the interior of the printer guide box 15; the tray holder having an exterior shoulder 43 forming a recess to receive the upper extending edge 44 of a printing tray 48 A handle 45 secured to the tray holder is formed of a pair of intersecting support arms 46,46 with a gripping portion 47 secured at the top of the arms to be grasped by the operator during use of the printer; the arms being narrower at the upper ends for the gripping portion 47 and wider at their lower ends to more completely support the tray holder and distribute the pressure of the force applied to the printer to the outer areas of the article to be printed. The printing tray 48 is provided with a central recess 49 defined by a depending edge 51 and adapted to receive a printing plate 52 in the form of a rubber cushion with an adhesive coating 53 on at least one surface thereof. The rubber cushion is preferably an one-eighth inch layer of cellular urethane of a low durometer and carries an image 54 thereon to receive and transfer the ink applied thereto to the article being ,printed. In this instance, the image has a design for one color of the total image, which design may be cut out by a pair of scissors and adhered to the rubber cushion. To prevent excess ink to be transferred onto the article from the outer edge 51 of the tray holder, the guide holder 15 is provided with an inwardly extending shoulder 55 (see FIG. 9) at the lower edges 21 of the sides, front and back to contact the depending edge 51 of the printing tray 48 before the edge can contact the article.

To coordinate and register the various design images, the rubber cushion 52 has the design 54 adhesively secured onto one surface of the sheet with the opposite surface having the adhesive coating 53 thereon. The cut-out image is positioned within the housing onto a master drawing of the total image over the designated portions of the one selected color and the rubber cushion 52 having adhesive on the lower surface is applied thereto to set the image. Then, the printing tray 48 is mounted on the tray holder 42 due to the edge 44 being received into the recess defined by the shoulder 43, and the printer is lowered into the housing so that the printing tray is positioned over and picks up the rubber cushion 52 due to the adhesive coating 53 on the upper surface thereof, and the printing tray, rubber cushion and image are removed from the housing 15. Thus, the printing plate is in proper registration with the housing 15 and base plate 12.

Additional printing plates are similarly prepared for each of the various colors to be utilized for the design on the article. Each image may be hand cut with a pair of scissors or may be stamped out of the rubber or plastic sheet and adhesively secured to the rubber cushion printing plate 52.

In use, the design of the final drawing, picture, etc. to be printed on the article, such as a greeting card, is broken down into partial images of the final design with one image for each color in the design. The guide members 34 and 35 are shifted to contact and register with the edges of the corner of the article and the adjusting nuts 37 tightened on the bolts 32 to retain the registration of the article. The printer consisting of the tray holder 42, printing tray 48, rubber cushion 52 and image 54 has the image inked by either a printing ink applied with a roller or by a stamp pad of the appropriate color and the inked image is inserted into the housing to accurately transfer the ink onto the article. This operation is repeated for each article to be printed.

Once the articles have all received the first color image, the first printing tray and image is removed from the tray holder and a second printing tray, cushion and image mounted on the tray holder. The second color is applied to the image, and the printer with this image is inserted into the housing so as to properly register the second image with the first image on the articles. This operation is repeated for the second image and color onto each article, and the operation repeated for each additional color until the final design is completed. Therefore, this apparatus will provide a multicolor printing or stamping operation for the accurate registration of the various colors of the final design desired by the operator.

Figure 8:
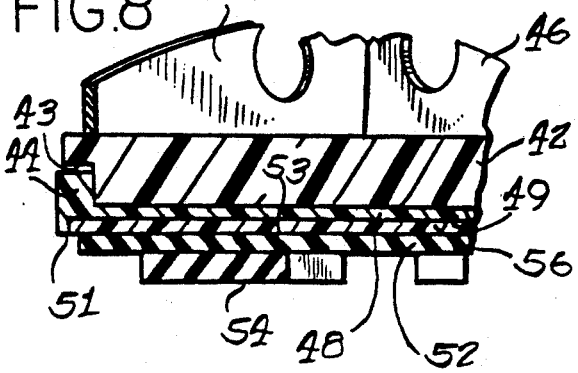
FIG. 8 is an enlarged partial cross sectional view of an alternate printer construction similar to FIG. 7 but showing a different arrangement of the members on the printing tray.

If one does not wish to invest in the plurality of printing trays necessary for the several colors for a printing job, a single printing tray 48 could be utilized with each rubber cushion 52 stripped off of the tray at the end of a single color operation and the cushion stored until required at a later time.

Where a rubber cushion 52 of the proper durometer is not available, a substitute cushion could be used in conjunction with a thin plastic sheet 56 (FIG. 8) of a size to fit within the recess 49 in the printing tray 48, the plastic sheet having an adhesive applied to at least the upper surface of the sheet so that the sheet adheres onto the underside of the printing tray 48 and the facing surface of the rubber cushion 52 has adhesive 53 to adhere to the plastic sheet. Therefore, the plastic sheet carrying the rubber cushion and image thereon could be stripped from the lower surface of the printing tray and reapplied at a later time.

INDUSTRIAL APPLICABILITY

The present invention relates to an improved technique for a method of block printing and apparatus for the manual printing of articles with several colors with complete registration of the colors in the design.

I claim:

1. The method of forming a multicolor image upon an article of paper, cardboard, etc., wherein the method includes the steps of providing a printing base with a rectangular housing open at the top and bottom to receive a manual printer having a plunger adapted to be grasped by the user, aligning the article on which the printing is to be impressed beneath the housing, inking an image bearing plate and inserting said printer carrying said image bearing plate into the housing for a single color of the final image and transferring the color to the article, substituting a second printing plate for a second color and repeating the transfer without realigning the article, and repeating the process for each succeeding color until the final image is completed.

2. The method as set forth in claim 1, in which each article is inserted below the rectangular open housing and aligned with adjustable guides on the base.

3. The method as set forth in claim 2, in which each article is releasably retained below said housing.

4. The method as set forth in claim 1, including the step of cushioning the image on said printing plate.

5. The method as set forth in claim 1, including the steps of positioning a drawing of the final image to be transferred to the articles below the housing, cutting out the portions of the image for a single color and positioning them on the final drawing, applying a rubber cushion into the housing to adhesively pick up the image, mounting the rubber cushion onto a printing tray, and removing the printing tray, rubber cushion and image from the housing for printing the inked image onto the articles.

6. An apparatus for the multicolor printing of images manually upon an article, such as paper, cardboard, etc., comprising a printer having a base plate, a generally rectangular housing open at both top and bottom and secured onto the base plate, means to align the article receiving the colored image under the housing upon the base plate, and a printer having a tray holder, a printing tray removably mounted on the holder, a printing plate received on said printing tray, and an upwardly projecting handle secured to said tray holder to be grasped by the printing operator.

7. The apparatus as set forth in claim 6, wherein said tray holder includes a generally flat plate secured to said handle and an exterior shoulder defining a circumferential recess receiving an edge of said printing tray.

8. The apparatus as set forth in claim 7, wherein said printing plate is formed of a cellular rubber cushion with an adhesive backing on at least one side thereof.

9. The apparatus as set forth in claim 8, wherein the printing plate carries an image capable of transferring a colored ink onto the article being printed.

10. The apparatus as set forth in claim 8, wherein a plurality of images are cut out and adhered onto several respective rubber cushions.

11. The apparatus as set forth in claim 10, in which each image may be cut out manually with a pair of scissors.

12. The apparatus as set forth in claim 8, wherein said housing conformably receives said tray holder, printing tray and printing plate to move vertically therein.

13. The apparatus as set forth in claim 6, wherein said printer base includes a pair of movable guide members removably secured thereon to align the edges of a corner of the article to be printed.

14. The apparatus as set forth in claim 13, wherein said printer base is provides with a pair of parallel slots for a side guide member and a slot for a top guide member, each slot receiving a bolt and nut to be manually tightened to secure the respective guide in position.

15. The apparatus as set forth in claim 12 in which said housing is provided with a generally U-shaped support surrounding and secured to three sides of said housing, said U-shaped support having a central offset edge secured to said printer base and having sufficient flexibility to allow said housing to be lifted from said printer base to allow said article being printed to slide under said housing into abutment with said guide members for alignment of the article for printing.

16. The apparatus as set forth in claim 15, wherein the flexibility of said housing flange acts to yieldably retain said articles in position on said printer base.

17. The apparatus as set forth in claim 6, in which said stamp handle includes a pair of intersecting members which interlock and have flanges with narrow upper ends and diverging lower flange portions secured onto said tray holder.

18. The apparatus as set forth in claim 17, wherein said handle comprises a rectangular upper end secured to said narrow upper flange ends.

19. The apparatus as set forth in claim 8, wherein said printer includes a thin plastic sheet having adhesive on at least one side thereof positioned between the printing tray and said rubber cushion.

20. An apparatus as set forth in claim 19, wherein said plastic sheet can be peeled off of the printing tray in order to change images without exchanging printing trays.

* * * * *